US005187837A

United States Patent [19]

Gunderson et al.

[11] Patent Number: 5,187,837

[45] Date of Patent: Feb. 23, 1993

[54] DOOR HINGE ASSEMBLY

[75] Inventors: Rick L. Gunderson, Greenville; David J. Donaghy, Gowen, both of Mich.

[73] Assignee: White Consolidated Industries, Inc., Cleveland, Ohio

[21] Appl. No.: 791,363

[22] Filed: Nov. 14, 1991

[51] Int. Cl.[5] ..... E05D 11/06; E05D 5/10

[52] U.S. Cl. ..... 16/375; 16/351; 16/386; 49/381; 49/392

[58] Field of Search ..... 16/139, 148, 344, 374, 16/286, 351, 375, 386; 312/214, 319; 49/193, 381, 382, 392, 402

[56] References Cited

U.S. PATENT DOCUMENTS 2,955,315 10/1960 Squire et al. ..... 16/375
4,084,291 4/1978 Crowe ..... 16/170
4,774,740 10/1988 Gidseg et al. ..... 16/344
4,864,691 9/1989 Gidseg et al. ..... 16/312

*Primary Examiner*—W. Donald Bray
*Attorney, Agent, or Firm*—Pearne, Gordon, McCoy & Granger

[57] ABSTRACT

A mullion mounted door hinge assembly for pivotally guiding upper and lower doors of a refrigerator. The hinge assembly includes a bracket which slidably accepts a generally cylindrical hinge pin. The hinge pin has a larger diameter center section and a pair of relatively smaller diameter end sections. Each of the end sections of the hinge pin extend into an accommodating opening in the upper or lower doors. The upper door is supported on an upwardly directed surface of the center section. A downwardly directed surface of the center section is supported by the lower door. A substantial portion of the weight of the upper door is transferred to the lower door and supported by the lower hinge means. A second preferred embodiment provides a stop means which engages a stop surface at a desired angular opening of the upper door of a refrigerator. The stop means includes a resilient terminal portion which deforms when the force thereon exceeds a predetermined threshold level to allow the upper door to open beyond the desired angular opening. The predetermined threshold level is determined by the amount of force which the hinge can sustain.

11 Claims, 3 Drawing Sheets

Fig. 1
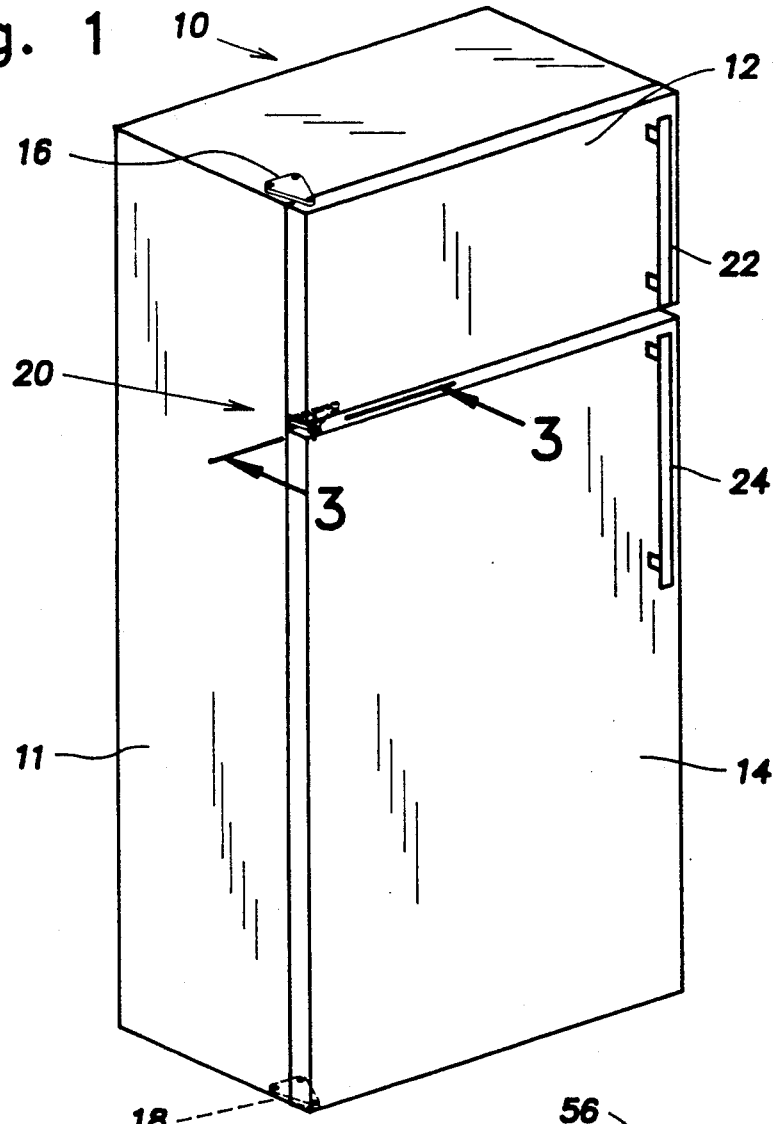
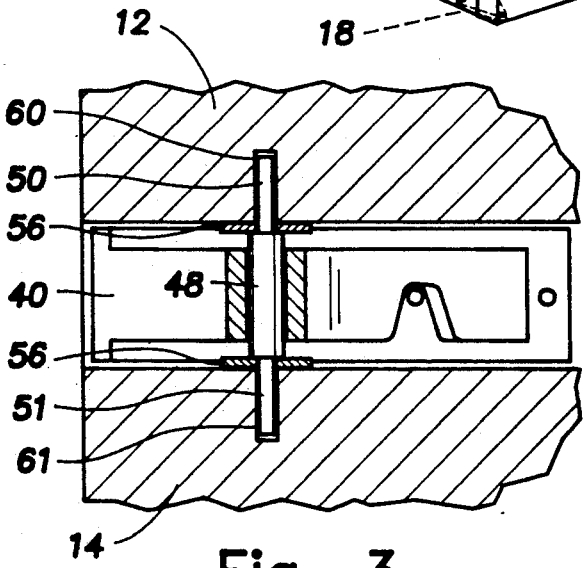
Fig. 3
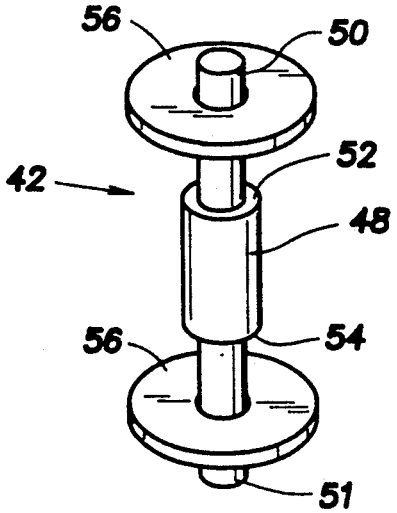
Fig. 4

DOOR HINGE ASSEMBLY

BACKGROUND OF THE INVENTION

1. Field of the Invention

The present invention relates generally to door hinges and, more specifically, to door hinge assemblies which provide pivotal guidance to the upper and lower doors of a refrigerator.

2. Brief Description of the Relevant Art

A wide variety of door hinge assemblies for mounting refrigerator doors to their associated cabinets are known to those skilled in the art. Typically, these assemblies provide an intermediate hinge pin support between upper and lower doors which operates as a bearing surface to support the load of the upper door and a vertically extending hinge pin to pivotally guide the upper and lower doors, keeping the doors in proper vertical alignment.

Just such a device is disclosed by U.S. Pat. No. 4,864,691 issued to Gidseg et al. The Gidseg patent discloses several hinge assemblies, including the use of a cabinet mounted hinge bracket intermediate the upper and lower doors which provides an opening for the vertically extending hinge pin. A pair of hinge members between the lower hinge of the upper door and the intermediate hinge cooperate to provide an access opening through which the hinge pin extends. The intermediate hinge bracket supports the weight of the upper door while a hinge pin guides the rotation of both the upper and lower doors, the weight of the lower door being borne by a lower hinge assembly. A similar hinge is shown by U.S. Pat. No. 4,774,740.

U.S. Pat. No. 4,084,291, issued to Crowe, discloses a cabinet mounted hinge bracket with a hinge pin extending therethrough. The upper end of the lower door and the lower end of the upper door provide inwardly directed thimbles which accept the vertically directed hinge pin. A cabinet mounted hinge bracket supports the weight of the upper door and provides guidance for the upper and lower doors as they pivot about the hinge pin, as is common in the art.

In all of the intermediate hinge assemblies known in the art, the intermediate hinge bracket supports the weight of the upper door and holds the hinge pin which pivotally guides the upper and lower doors. Since the intermediate hinge bracket is typically located in the area of the cabinet where there is limited structural strength, the frame in this area must be built up to support the weight of the upper door. Specifically, if the hinge is to be attached to the cabinet at the mullion strap, which is a preferred location, a frame capable of supporting the weight of the upper door must be introduced to the mullion region. Due to the limited strength at the mullion, it is common, as shown by the Gidseg and Crowe references, for the intermediate hinge bracket to be attached to the cabinet frame at a location which is close to, but not at, the mullion strap.

Increasing the size and strength of the frame in the area of the mullion to allow mounting of the intermediate hinge decreases the amount of thermal insulation that can be provided between the upper and lower compartments of the refrigerator. Furthermore, adding to the size of the frame also increases the weight of the refrigerator and complexity of assembly and, hence, the expense of the finished refrigerator.

Naturally, consumers increasingly demand lighter, more efficient and less expensive appliances. Furthermore, governmental regulations require ever-increasing levels of energy efficiency for home appliances. Therefore, there exists a need for an intermediate hinge assembly which will provide a means of support for the upper door of the refrigerator without unnecessarily adding to the frame or load at the mullion area.

SUMMARY OF THE INVENTION

The present invention is directed towards eliminating some of the problems and shortcomings of the intermediate hinges known in the art. Specifically, one of the objects of the present invention is to eliminate the need for added structural strength at the mullion region adjacent the intermediate hinge bracket.

In accordance with the present invention, the refrigerator of the present invention includes a series of hinge means which pivotally mount the upper and lower refrigerator doors to the refrigerator cabinet. The upper hinge means pivotally engages the upper surface of the upper door, the lower hinge means pivotally engages the lower surface of the lower door and the intermediate hinge means pivotally engages both the upper and the lower doors.

Further in accordance with the present invention, the intermediate hinge means includes an intermediate hinge bracket which is mounted to the cabinet at the mullion region intermediate the upper and lower compartments and provides a vertically directed aperture which accepts a hinge pin. The hinge pin is generally cylindrical in shape, having a center section with a larger diameter than the two end sections. The center section provides upwardly and downwardly directed faces which define a generally annular surface, the smaller end sections of the hinge pin extending from the center thereof.

Further in accordance with the present invention, the larger center section of the hinge pin is in sliding engagement with the intermediate hinge bracket. The smaller end sections of the hinge pin are placed within accepting apertures in the upper and lower doors.

Further in accordance with the present invention, the downwardly directed face of the upper door is supported by the upwardly directed face of the center section of the hinge pin and the downwardly directed face of the center section of the hinge pin is supported by the upwardly directed face of the lower door. The weight of the upper door is effectively transferred through the hinge pin, into the lower door, and eventually to the lower hinge means.

In accordance with the foregoing, it is a primary object of the present invention to provide an intermediate hinge for a refrigerator which allows for the transferral of the weight of the upper door to the lower hinge, the intermediate hinge bracket primarily acting as a rotation guide for the upper and lower doors.

Further in accordance with the primary object of the present invention, the hinge pin includes upwardly and downwardly directed annular faces which engage the upper and lower refrigerator doors, respectively. The weight of the upper door is transmitted through the hinge pin to the lower door.

In accordance with a preferred embodiment of the present invention, the upper door is provided with stop means to limit the angular opening of the door. The stop means includes the intermediate hinge bracket and a resilient stop member which is mounted on the underside of the upper door.

In further accordance with a preferred embodiment of the present invention, the intermediate hinge bracket provides a stop surface to receive the stop member. The stop member engages the stop surface when the upper door reaches the maximum desired angular opening.

Further in accordance with a preferred embodiment of the present invention, the stop member is formed of a resilient plastic material. The resiliency is selected such that the stop member will yield or deform when it is subjected to a force exceeding a predetermined threshold force, allowing the door to open beyond the maximum desired angular opening.

BRIEF DESCRIPTION OF THE DRAWINGS

A fuller understanding of the invention may be had by referring to the following description and claims taken in conjunction with the accompanying drawings, wherein:

FIG. 1 is a perspective view of a refrigerator incorporating the hinge means of the present invention;

FIG. 3 is a front cross-sectional view of the intermediate hinge of the present invention taken along line 3—3 of FIG. 1;

FIG. 4 is a perspective view of the hinge pin and annular bearings of the intermediate hinge means of the present invention;

DETAILED DESCRIPTION OF THE PREFERRED EMBODIMENTS

Figure 2:
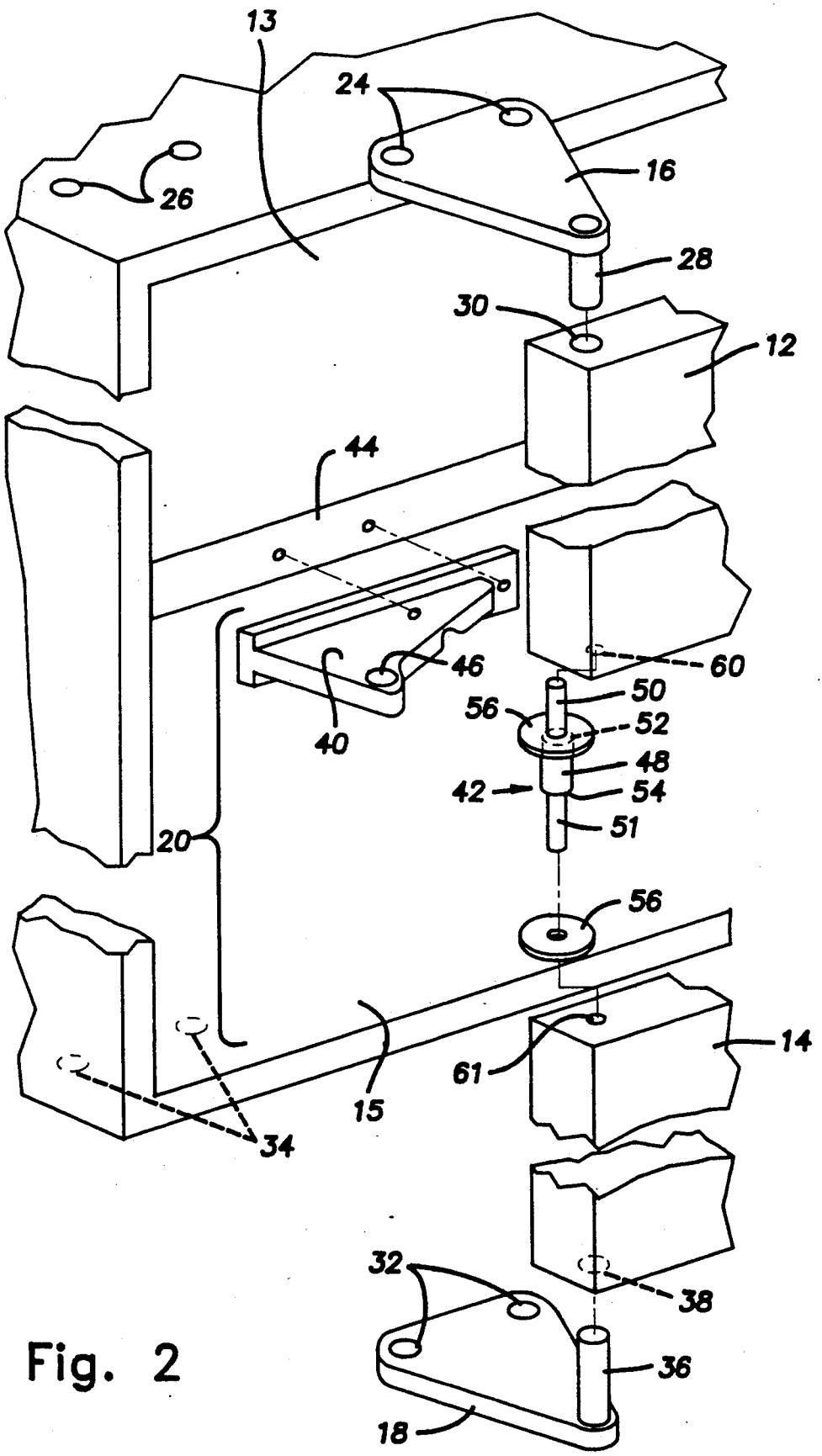
FIG. 2 is a fragmentary exploded perspective view of the refrigerator incorporating the present invention.

With reference to FIGS. 1 and 2, there is shown the refrigerator 10 embodying the present invention. The refrigerator includes upper and lower doors 12, 14 which respectively cover upper and lower food storage compartments 13, 15, and a series of hinge means associated with the upper and lower doors consisting of upper hinge means 16, lower hinge means 18 and intermediate hinge means 20.

Typically, in this type of refrigerator, the upper food storage compartment 13 is a freezer compartment and is set to maintain foods at a relatively lower temperature than the lower food storage compartment 15 wherein the fresh foods are located. Each of the upper and lower doors 12, 14 include handles 22, 24 to facilitate opening the doors about the vertical axis defined by the hinge means to gain access to the respective food storage compartment, as is well known in the art. The hinge means 16, 18, 20 can be placed on either the left or right-hand side of the cabinet 11 and upper and lower doors 12, 14 to enable the doors to open in the desired direction. Naturally, the handles 22, 24 are located on the side opposite the hinge means, as illustrated.

With specific reference to FIG. 2, the upper hinge means 16 is shown as being generally triangular in shape, and having a pair of holes 24 at adjacent corners thereof. The holes 24 are dimensioned and positioned to align with holes 26 in the top surface of the refrigerator cabinet 11. The holes 24 in the upper hinge means 16 and the holes 26 in the cabinet 11 cooperate to accept appropriate fastening means such as screws, bolts or the like (not shown) and thereby attach the upper hinge means 16 to the refrigerator cabinet 11. The other corner of the upper hinge means 16 provides a downwardly directed hinge pin 28 which extends into a hole 30 provided in an upper surface of the upper refrigerator door 12, hingeably mounting the upper portion of the upper door to the cabinet, as will be more fully described hereafter.

With further reference to FIG. 2, the lower hinge means 18 is generally identical to the upper hinge means 16, having a generally triangular shape with a pair of holes 32 at adjacent corners thereof. The holes 32 are dimensioned and adapted to align with holes 34 in the bottom of the refrigerator cabinet 11. The holes 32 in the lower hinge means 18 and the holes 34 in the cabinet cooperate to accept an appropriate fastening means such as a screw, bolt or the like (not shown) and thereby attach the lower hinge means 18 to the refrigerator cabinet 11. The other corner of the lower hinge means 18 provides an upwardly directed hinge pin 36 which extends into a hole 38 provided in a lower surface of the lower refrigerator door 14, hingeably mounting the lower portion of the lower door to the cabinet, as will be more fully described hereafter. Naturally, the design and mounting of the upper and lower hinge means can be presented in many forms without departing from the scope of the appended claims, the foregoing description being provided to illustrate the preferred embodiment of the present invention.

The intermediate hinge means 20 includes an intermediate hinge bracket 40 and a generally cylindrical hinge pin 42. The hinge bracket is mounted to the mullion strap 44, and provides a generally vertically directed opening or hole 46 which is dimensioned to slidably receive the hinge pin 42. The hinge pin 42 is generally cylindrical in shape, having a larger-diameter center section 48 and a pair of relatively smaller-diameter end sections 50, 51. In the preferred embodiment, the hinge pin is formed as a single piece. Naturally, the hinge pin could be formed in more than one piece, for example, as a pin and bushing combination. As particularly shown in FIGS. 2 and 4, the center section 48 of the hinge pin 42 provides upwardly and downwardly directed annular surfaces 52, 54, out of which the upper and lower end sections 50, 51, respectively, extend.

The center section 48 of the hinge pin 42 is adapted to slidably fit within the opening 46 provided in the intermediate hinge bracket 40. The upwardly and downwardly directed annular surfaces 52, 54 are each provided with an annular bearing or washer 56 which slidably fits over the respective end section 50,51 of the hinge pin 42. The bearings 56 space the upper and lower refrigerator doors 12, 14 from the intermediate hinge bracket 40, and provide a larger surface to bear the load of the upper door 12 than can be provided by the annular surfaces 52, 54 of the hinge pin 42. Naturally, the diameter of the center section 48 of the hinge pin 42 is limited by the size of the opening 46 in the intermediate hinge bracket 40 through which it slidably extends. Finally, and as best shown in FIG. 3, the upper and lower end sections 50, 51 of the hinge pin 42 extend into accommodating holes 60, 61 in the upper and lower doors 12, 14, respectively.

Assembly of the refrigerator incorporating the hinge means of the present invention will hereafter be described with reference to the foregoing description and drawing figures.

As a matter preliminary to the mounting of the upper and lower doors onto the cabinet, the direction of opening of the doors must be decided upon. Once that decision is made, the lower hinge means 18 is attached by screws, bolts or the like to the bottom of the refrigerator cabinet 11. The lower door 14 is thereafter placed upon the upwardly directed hinge pin 36 of the lower hinge means 18 such that the hinge pin 36 extends into the accommodating hole 38 in the lower surface of the lower door 14.

With the lower portion of the lower door 14 in place, the intermediate hinge means 20 can be attached to the mullion 44 by suitable attachment means such as screws, bolts or the like. The lower door is thereafter held generally in vertical alignment such that the opening or hole 61 in the upper surface of the lower door 14 is directly below the opening 46 in the intermediate hinge bracket 40. An annular bearing or washer 56 is placed on upper surface of the lower door 14 such that the hole therein is aligned with the opening 61 in the surface of the lower door 14 and the hole 46 in the intermediate hinge bracket 40. At this point the hinge pin 42 can be inserted through the hole 46 in the intermediate hinge bracket 40 such that the lower end section 51 extends into the hole 61 formed in the upper surface of the lower door 14. The annular washer 56 is in simultaneous direct face-to-face contact with the upper surface of the lower door 14 and the downwardly directed annular surface 54 of the center section 48 of the hinge pin 42.

Thereafter, an annular washer 56 is place over the upper end section 50 of the hinge pin 42, resting directly upon the upwardly directed annular surface 52 of the center section 48 of the hinge pin 42. The upper door 12 is placed on the hinge pin such that the smaller end section 50 extends into the hole 60 formed in the lower surface of the upper door 12. The annular washer 56 is in simultaneous direct face-to-face contact with the lower surface of the upper door 12 and the upwardly directed surface 52 of the center section 48 of the hinge pin 42.

With the upper door 12 held generally in vertical alignment, the downwardly directed hinge pin 28 of the upper hinge means 16 is inserted into the accommodating hole 30 in the upper surface of the upper door 12. The upper hinge means 16 is attached to the upper surface of the cabinet 11 by screws, bolts or the like to complete assembly. Naturally, the handles 22, 24 can be attached to the doors 12, 14 either before or after mounting the doors onto the cabinet 11.

It is important to note that, when properly assembled, the upper door 12 rests directly upon the washer 56 adjacent the upwardly directed surface 52 of the center section of the hinge pin 42 and that the downwardly directed surface 54 of the hinge pin 42 rests upon the washer 56 adjacent the lower door 14. This configuration transfers the weight of the upper door 12 directly to the lower door 14 and enables the intermediate hinge bracket 40 to act primarily as a pivotal guide, rather than as a load bearing member. This greatly reduces the amount of structural strength which must be provided by the mullion 44 underlying the intermediate hinge bracket 40.

Figure 5:
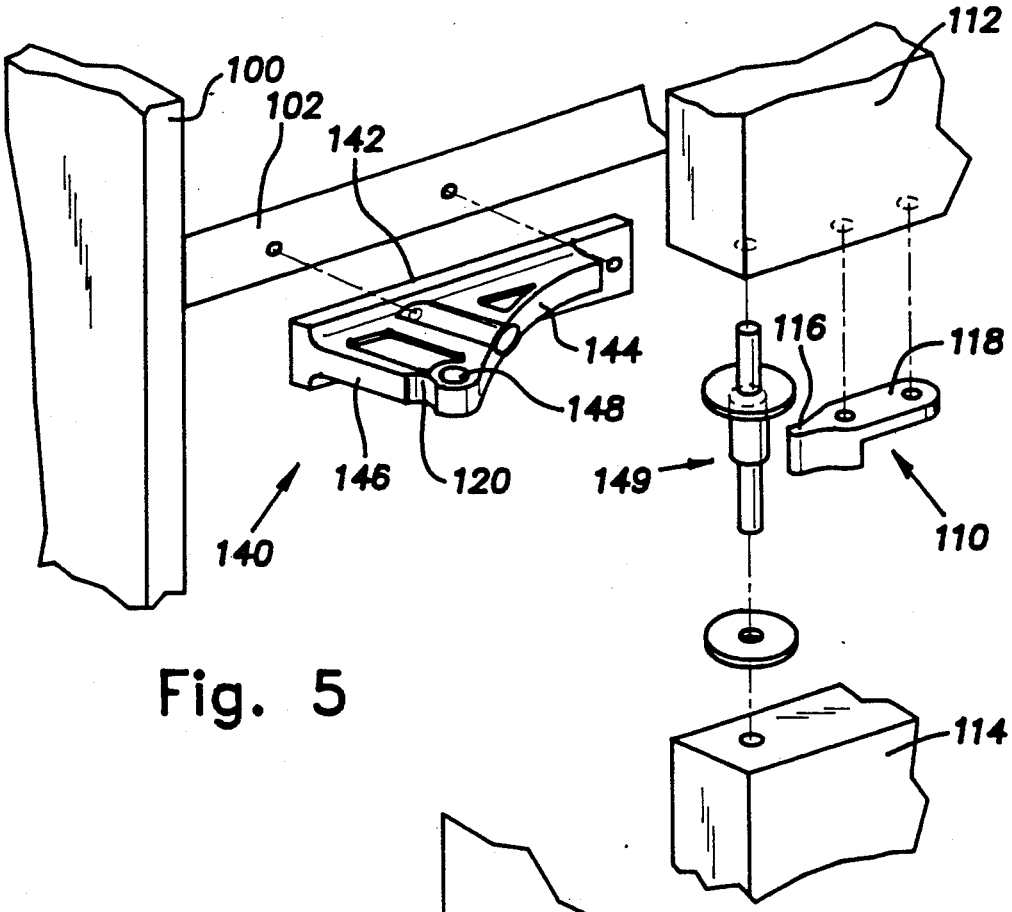
FIG. 5 is an exploded perspective view of the stop member and intermediate hinge bracket of a preferred embodiment of the present invention; and, FIG. 6 is an elevational view of the stop means and intermediate hinge bracket with the door and stop means shown in phantom in various positions which depict opening of the door.
Figure 6:
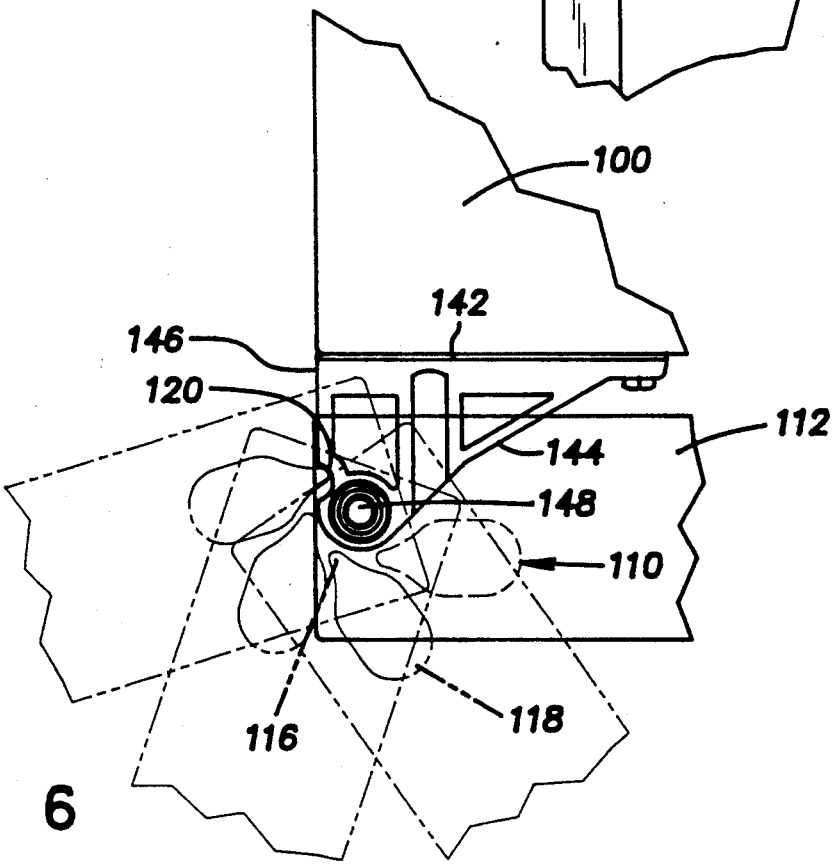

With reference to FIGS. 5 and 6, a second preferred embodiment of the present invention is depicted which includes a stop means 110 and a hinge bracket 140. The stop means 110 is mounted to a lower surface of the upper door 112 by means of screws or other appropriate fastening means. The stop means 110 is formed out of a resilient plastic and has an oval main body 118 and a more narrow terminal section 116. The oval main body 118 is generally thin, its only purpose being to ensure that the stop means 110 is firmly attached to the upper door, while the terminal section 116 is substantially thicker, providing a stiff but bendable bearing member.

The hinge bracket 140 is generally triangular in shape, having a rear 142 which is mounted to the cabinet 100 at the mullion 102, a front 144 and a side 146. A generally circular, reinforced hinge pin receiving hole 148 is provided in the vicinity of the intersection of the front 144 and side 146. The reinforced hinge pin receiving hole 148 is dimensioned to accomodate a hinge pin 149 which extends between the upper door 112 and a lower door 114.

The side 146 also provides a stop surface 120 which is engaged by the stop means 110 to limit the angular motion of the upper door 112, as will hereafter be described. Preferably the stop surface 120 is in the form of a semicircular notch located adjacent the reinforced portion surrounding the hinge receiving hole 148. Although the semicircular stop surface is preferred by the applicant, the stop member and stop surface be any configuration or shape and can even be merely a flat surface provided by the side 146.

As shown in phantom in FIG. 6, when the upper door 112 and stop means 110 rotate about the hinge, the terminal end 116 of the stop means 110 stays in close proximity to the outer edge of the reinforced portion surrounding the hinge receiving hole. When the upper door reaches the maximum desired angular opening, the terminal portion 116 of the stop means engages the notched opening 120 on the side 146 and prevents the upper door from being further opened.

When the stop means 110 is under a force which exceeds a predetermined threshold level, for example when someone is leaning or pushing on the upper door, the terminal portion 116 of the stop means will deform and allow the door to open further, prior to any permanent damage being done to the hinge, hinge bracket or stop means. The predetermined threshold level is determined by the amount of force which the hinge can sustain.

Installation of the stop means preferably takes place prior to the upper door being mounted on the hinge means. Alternatively, the stop means could be mounted to the upper door after the upper door has been installed.

It is clear that the present description is provided merely to illustrate the preferred embodiment of the present invention, the invention being capable of design in several different ways which are defined by the present invention. For example, although the present invention discloses the use of separate annular washers which displace and bear the load of the upper door, clearly the same result could be accomplished by reinforcing the doors or otherwise integrally forming the washers on the doors. Also, it is clear that the upper and lower hinge means can take on several different forms without departing from the scope of the present invention as defined by the following claims. Furthermore, it is clear that the stop means and hinge bracket can be presented in several forms without departing from the scope of the invention as claimed. For example, the hinge bracket and stop means are disclosed as being between the upper and lower doors, however, they have utility in other applications.

What is claimed is:

1. A refrigerator cabinet comprising upper and lower storage compartments, each of said upper and lower storage compartments being provided with hingeably mounted doors to sealably close said upper and lower storage compartments; and, hinge means fastened to said cabinet for pivotally mounting said upper door and said lower door on said cabinet, said hinge means providing means for transferring substantially all weight of said upper door to said lower door.

2. A refrigerator cabinet according to claim 1, wherein said hinge means comprises upper, lower and intermediate hinges, said upper hinge pivotally engaging an upper surface of said upper door, said lower hinge pivotally engaging a lower surface of said lower door and said intermediate hinge pivotally engaging both of said upper and lower doors.

3. A refrigerator cabinet according to claim 2, wherein said intermediate hinge includes a hinge pin and an intermediate hinge bracket, said hinge pin being generally vertically directed and having oppositely directed ends of a first diameter, each of which are received by one of said upper and lower doors, said hinge pin being provided with a center section of a second diameter.

4. A refrigerator cabinet according to claim 3, wherein said hinge pin center section slidably extends through an opening in said intermediate hinge bracket, said center section providing an upwardly directed face which supports said upper door and a downwardly directed face which is supported by said upper surface of said lower door.

5. A refrigerator cabinet according to claim 4, wherein said means for transferring substantially all of said weight of said upper door to said lower door includes said intermediate hinge.

6. A refrigerator cabinet according to claim 4, wherein said second diameter is larger than said first diameter.

7. A device to limit the angular opening of a refrigerator door, said refrigerator door being pivotally attached to a hinge bracket, comprising:

a stop means mounted to said refrigerator door, said stop means engaging a stop surface when said refrigerator door is at a desired angular opening, said stop surface being provided by said hinge bracket; and, deformable means which allows said refrigerator door to open beyond said maximum desired angular opening when said deformable means is subjected to a force exceeding a predetermined threshold level.

8. A device according to claim 7, wherein deformable means includes a terminal portion of said stop means.

9. A device according to claim 7, wherein said stop surface comprises a semicircular notch.

10. A device according to claim 7, wherein said stop means includes a main body portion and a terminal portion, said main body portion being attached to said refrigerator door and said terminal portion being in engagement with said stop surface when said regrigerator is at said desired angular opening.

11. A device according to claim 10, wherein said deformable means includes said terminal portion.

* * * * *